US011476556B1

(12) United States Patent
Mardi et al.

(10) Patent No.: US 11,476,556 B1
(45) Date of Patent: Oct. 18, 2022

(54) REMOTE ACTIVE COOLING HEAT EXCHANGER AND ANTENNA SYSTEM WITH THE SAME

(71) Applicant: XILINX, INC., San Jose, CA (US)

(72) Inventors: Mohsen H. Mardi, Saratoga, CA (US); Gamal Refai-Ahmed, Santa Clara, CA (US); Suresh Ramalingam, Fremont, CA (US); Volker Aue, Dresden (DE)

(73) Assignee: XILINX, INC., San Jose, CA (US)

( * ) Notice: Subject to any disclaimer, the term of this patent is extended or adjusted under 35 U.S.C. 154(b) by 71 days.

(21) Appl. No.: 17/102,149

(22) Filed: Nov. 23, 2020

(51) Int. Cl.

| | |
|---|---|
| ***H01Q 1/00*** | (2006.01) |
| ***H01Q 1/02*** | (2006.01) |
| ***F28F 1/42*** | (2006.01) |
| ***F28F 1/00*** | (2006.01) |
| ***H01Q 1/42*** | (2006.01) |

(52) U.S. Cl.
CPC ..... *H01Q 1/02* (2013.01); *F28F 1/003* (2013.01); *F28F 1/422* (2013.01); *H01Q 1/42* (2013.01)

(58) Field of Classification Search
CPC ... H01Q 1/02; H01Q 1/42; F28F 1/003; F28F 1/422
USPC ..... 343/904
See application file for complete search history.

(56) References Cited

U.S. PATENT DOCUMENTS

| | | | | |
|---|---|---|---|---|
| 4,807,441 | A * | 2/1989 | Agee | H01L 23/467 257/E23.099 |
| 5,445,218 | A * | 8/1995 | Nieh | F28D 9/0012 165/125 |
| 7,768,457 | B2 | 8/2010 | Pettus et al. | |
| 9,057,567 | B2 * | 6/2015 | Lyon | F28D 15/00 |
| 9,356,359 | B2 | 5/2016 | Ma et al. | |
| 9,453,691 | B2 * | 9/2016 | Lyon | F28F 3/12 |
| 10,074,954 | B1 * | 9/2018 | Burkholder | H01S 3/0407 |
| 2006/0033674 | A1 * | 2/2006 | Essig, Jr. | F24S 23/715 343/915 |
| 2007/0251016 | A1 * | 11/2007 | Feher | A47C 7/748 455/39 |
| 2009/0000031 | A1 * | 1/2009 | Feher | A47C 7/74 5/423 |
| 2012/0152498 | A1 * | 6/2012 | Lyon | F28F 3/048 165/104.19 |

(Continued)

FOREIGN PATENT DOCUMENTS

| | | | |
|---|---|---|---|
| WO | 2008012533 | A1 | 1/2008 |
| WO | 2014196144 | A1 | 12/2014 |

*Primary Examiner* — Jean B Jeanglaude
(74) *Attorney, Agent, or Firm* — Patterson + Sheridan, LLP

(57) ABSTRACT

A heat exchanger and an antenna assembly having the same are described herein that enable a compact antenna design with good thermal management. In one example, a heat exchanger is provided that includes tube-shaped body. A main cooling volume is formed between the top and bottom surfaces proximate to the outside wall. The main cooling volume has an inlet formed through the top surface and an outlet formed through the bottom surface. A return volume is formed adjacent the inside diameter wall and is circumscribed by the main cooling volume. The return volume has an outlet formed through the top surface and an inlet formed through the bottom surface. One or more exterior fins are coupled to an exterior side of the outside wall. A plurality of fins extend into the main cooling volume. A plurality of inner fins extend into a passage from the inside diameter wall.

20 Claims, 7 Drawing Sheets

(56) References Cited

U.S. PATENT DOCUMENTS

| | | | | |
|---|---|---|---|---|
| 2014/0158326 | A1* | 6/2014 | Lyon | F28D 15/00 165/104.19 |
| 2019/0368827 | A1* | 12/2019 | Blennius | H01Q 1/281 |

* cited by examiner

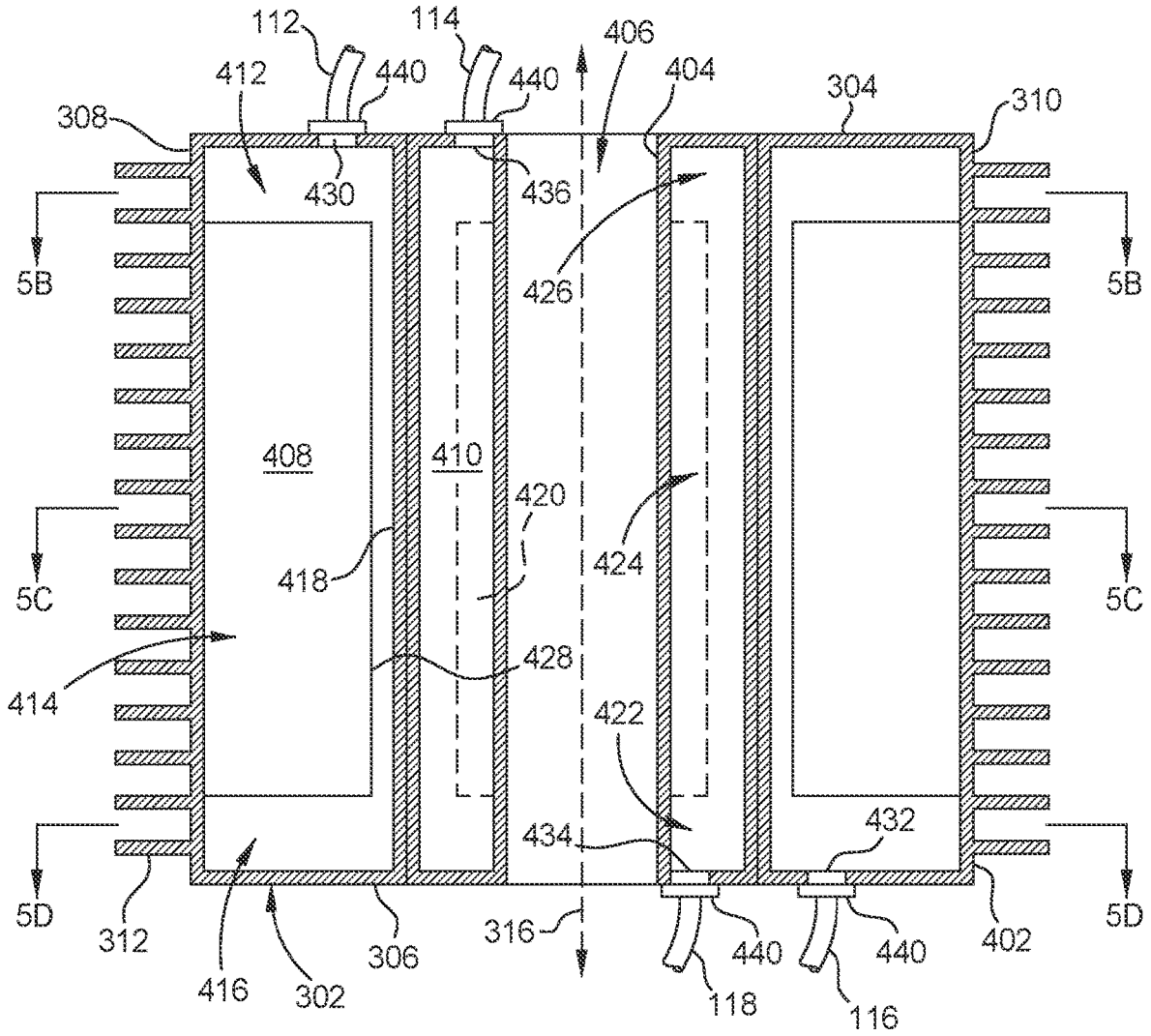
FIG. 4
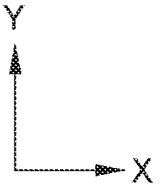

REMOTE ACTIVE COOLING HEAT EXCHANGER AND ANTENNA SYSTEM WITH THE SAME

TECHNICAL FIELD

Embodiments of the present invention generally relate to a heat exchanger for active cooling and an antenna system having the same.

BACKGROUND

As mobile communications evolve from 4G to 5G mobile networks, massive-element antenna assemblies have been employed to enable network transmissions at ultra-high speeds with ultra-low latency. However, massive-element antennas increase the amount of heat generated within the antenna assembly due to the increased power consumption associated with the large number of analog devices with the antenna assembly. To compensate for the increased heat associated in the increase in power, larger heat sinks can be utilized. However, the use of large heat sinks undesirably increases the size and weight of the antenna assembly, thus limiting the locations in which such large, heavy, and cumbersome antenna assemblies may be mounted.

Thus, there is a need for an improved antenna system able to efficiently handle heat generated by massive-element antennas devices.

SUMMARY

An active cooling heat exchanger and an antenna assembly having the same are described herein that enable a compact antenna design with good thermal management. In one example, a heat exchanger is provided that includes a tube-shaped body having an inside wall, an outside wall, a top surface and a bottom surface. A main cooling volume is defined within the body and includes a first, second and third plenums. The first plenum is formed in the body adjacent the top surface and an inlet formed through the top surface. The second plenum formed in the body and fluidly couples the third plenum to the first plenum. The third plenum formed in the body adjacent the bottom surface and the second plenum. The third plenum has an outlet formed through the bottom surface. A plurality of fins extend into the second plenum with at least some of the plurality of fins being coupled to the outside wall. A passage is formed through the body and bounded by the inside wall. One or more exterior fins are coupled to an exterior side of the outside wall.

In other example, a heat exchanger is provided that includes cylindrical ring-shaped body having an inside diameter wall, an outside diameter wall, a top surface and a bottom surface. The inside diameter wall bounding a passage formed vertically through the body. A main cooling volume is formed in the body between the top surface and the bottom surface. The main cooling volume is disposed proximate to the outside diameter wall. The main cooling volume has an inlet formed through the top surface and an outlet formed through the bottom surface. A return volume is formed in the body adjacent the inside diameter wall and is circumscribed by the main cooling volume. The return volume has an outlet formed through the top surface and an inlet formed through the bottom surface. One or more exterior fins are coupled to an exterior side of the outside diameter wall. A plurality of fins extend into the main cooling volume in an interleaving radial orientation. A plurality of inner fins extend into the passage in a radial orientation from the inside diameter wall.

In yet other example, an antenna system is provide that includes an antenna assembly, a heat exchanger and a pump. The antenna assembly includes an antenna array, a radome disposed over the antenna array, and an active cooling device disposed below the radome and having a passage formed therein for circulating a heat transfer fluid therethrough. The heat exchanger includes a cylindrical ring-shaped body having an inside diameter wall, an outside diameter wall, a top surface and a bottom surface. The inside diameter wall bounding a passage formed vertically through the body. A main cooling volume is formed in the body between the top surface and the bottom surface. The main cooling volume is disposed proximate to the outside diameter wall. An inlet is formed through the top surface and couples the main cooling volume to an outlet the active cooling device of the antenna assembly. An outlet is formed through the bottom surface and couples to the main cooling volume. One or more exterior fins are coupled to an exterior side of the outside diameter wall. A plurality of fins extend into the main cooling volume. The pump is coupled between the outlet of the main cooling volume and an inlet of the active cooling device.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 4 is a schematic sectional view of one example of an active heat exchanger that may be utilized with an antenna assembly.

To facilitate understanding, identical reference numerals have been used, where possible, to designate identical elements that are common to the figures. It is contemplated that elements of one embodiment may be beneficially incorporated in other embodiments.

DETAILED DESCRIPTION

Examples of a heat exchanger and an antenna system having the same are described below that utilize integrated active cooling to provide enhanced temperature management of the solid state components within an antenna assembly of the antenna system. The heat exchanger of the antenna system is decoupled from the antenna assembly (i.e., the heat exchanger and antenna assembly are independent and physically separate units), thus allowing both of the heat exchanger and antenna assembly to be separately constructed in a manner unconstrained from the design constraints of the other. Active cooling integrated into the antenna system allows for improved thermal management of high performance electronics within the antenna assembly without of the bulk of structures/devices that would be required to shed heat directly from the antenna assembly into the ambient environment. Advantageously, the efficient thermal management enables greater processing speeds with lower ultra-high speeds with ultra-low latency without the use of large onboard antenna heat sinks as would be required in conventional devices. Heat removed from the antenna assembly by the active cooling is transferred to a separate and remote heat exchanger where the heat can be efficiently passed to the ambient environment. By making the active cooling of the antenna system remote from the antenna assembly itself, the size and cost of the antenna assembly is beneficially reduced, while the heat exchanger optimized without concern of the weight or size constraints of the detached antenna assembly. Moreover, as the antenna assembly is purposefully designed without having to accommodate onboard heat sinks with active cooling, the size and weight of the antenna assembly is significantly less than conventional designs. The light weight of the antenna assembly is very important for enabling large scale implementation of and reliable performance from massive-element antennas utilized by next generation (e.g., 5G) mobile communication devices without a corresponding need for increase antenna assembly footprint or cost. Furthermore, improved thermal management of the active components and circuits of the antenna circuit board allows a more compact antenna design, thus enabling a smaller, lighter and more desirable antenna footprint, while making cooling simpler and improving the service life.

Figure 1:
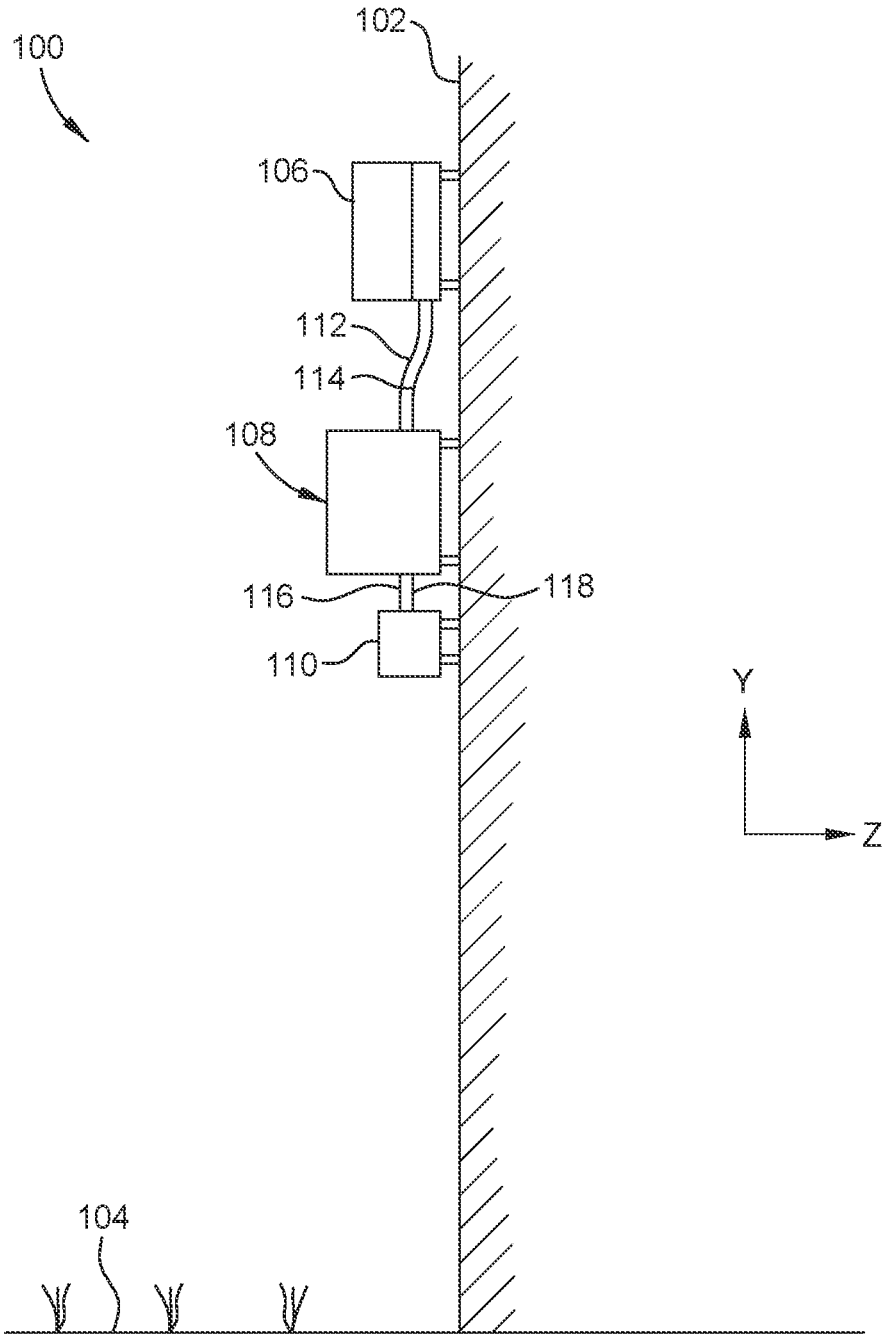
FIG. 1 is a schematic side view of an antenna system that includes an antenna assembly coupled with an active heat exchanger.

Turning now to FIG. 1, a schematic sectional view of one example of an antenna system 100 is illustrated that includes an active cooling antenna assembly 106 fluidly coupled to a detached (i.e., remote and separate) heat exchanger 108. The heat exchanger 108 is configured to provide cool heat transfer fluid circulated through one or more active cooling elements of the antenna assembly 106. In the example depicted in FIG. 1, the heat exchanger 108 is spaced in close proximity to the antenna assembly 106, for example, within less than a few feet. The heat exchanger 108 is fluidly coupled to antenna assembly 106 by an outlet conduit 112 and an inlet conduit 114. The inlet conduit 114 provides cooled heat transfer fluid to antenna assembly 106, while the outlet conduit 112 returns hot heat transfer fluid heated by the antenna assembly 106 to the heat exchanger 108 for cooling of the heat transfer fluid within the heat exchanger 108. The separate construction of the heat exchanger 108 and the antenna assembly 106 enables the size and configuration of the heat exchanger 108 to be essentially decoupled from the size and design limitations of the antenna assembly 106, thus allowing optimization of each of the assembly and exchanger 106, 108 to be unconstrained and separate from the optimization of the other. The separate construction of the heat exchanger 108 and the antenna assembly 106 accordingly enables a more compact design of the antenna system 100, thus enabling a smaller, lighter and more desirable footprint, while making cooling simpler and improving the service life. The separate construction enables the heat transfer capacity of the heat exchanger 108 to be enhanced while allowing a compact and lightweight antenna assembly 106, which is particularly beneficial for massive-element antenna assemblies that enable ultra-high speeds, ultra-low latency network transmissions.

In addition to the heat exchanger 108 and the antenna assembly 106, the antenna system 100 also includes a pump 110. The pump 110 circulates the heat transfer fluid between the heat exchanger 108 and the antenna assembly 106. In the example depicted in FIG. 1, a pump inlet conduit 116 couples an inlet of the pump 110 to the outlet of the heat exchanger 108, while a pump outlet conduit 118 couples an outlet of the pump 110 to the return inlet of the heat exchanger 108. Optionally, the pump outlet conduit 118 may be coupled directly to the antenna assembly 106, bypassing a second pass through the heat exchanger 108.

In the example depicted in FIG. 1, at least the heat exchanger 108 and the antenna assembly 106 are coupled to a structure 102. The structure 102 may be fixed the ground 104, such as a building, tower, bridge, radio antenna or other structure desirable to mount an antenna. Alternatively, the structure 102 may be alternatively mounted to a moving structure 102, such as as vessel, airplane, truck, automobile, train or other moving structure desirable to mount an antenna. The pump 110 may also be mounted to the structure 102.

The heat exchanger 108 may be mounted vertically below, vertically above or to one of the sides the antenna assembly 106. The heat exchanger 108 may be also be mounted between the antenna assembly 106 and the structure 102.

Figure 2:
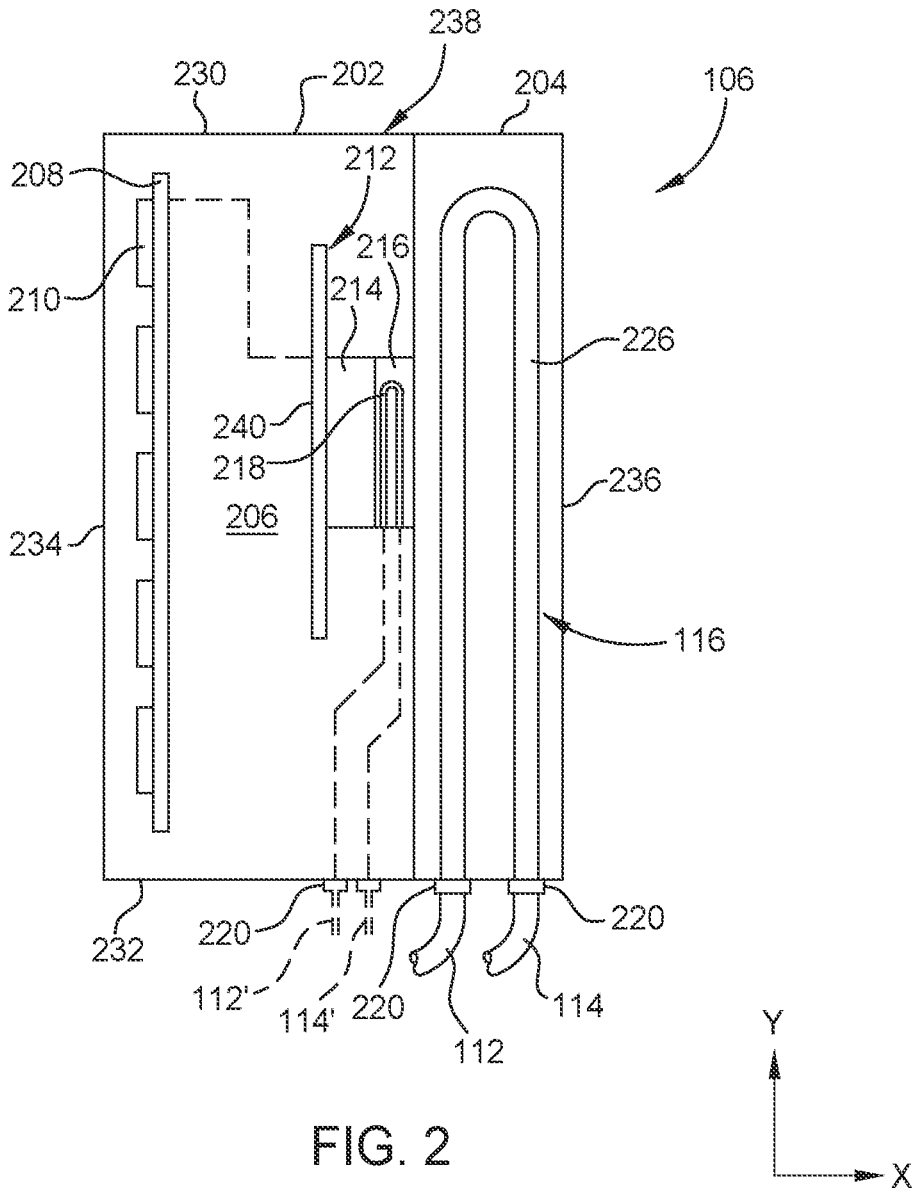
FIG. 2 is a schematic sectional view of one example of an antenna assembly that may be utilized with an active heat exchanger.

FIG. 2 is one example of the active cooling antenna assembly 106 of the antenna system 100 depicted in FIG. 1. It is contemplated that the antenna assembly 106 may have alternative configurations.

The antenna assembly 106 includes a radome 202, a heat sink 204, an antenna array 208, an antenna circuit board 212 and at least one active cooling device 216. The radome 202 is sealingly coupled to the heat sink 204, forming a housing 238 having an interior volume 206 in which the antenna array 208 and the antenna circuit board 212 are disposed. The housing 238 has a top surface 230, a bottom surface 232, an antenna side 234, and a mounting side 236. The mounting side 236 is used to couple the antenna assembly 106 to the structure 102 (shown in FIG. 1) through the use of brackets, clamps and/or fasteners, not shown. The antenna side 234 is the portion of the radome 202 that covers the antenna array 208. The exterior surfaces 230, 232 and sides 234, 236 of the housing 238 provide weather protection for the antenna assembly 106, protecting the antenna array 208 and the antenna circuit board 212 from the harsh elements of the outside ambient environment.

The heat sink 204 is generally fabricated from a metal material, such as aluminum or zinc die case, and is utilized to remove heat generated with the housing 238. The heat sink 204 may include exterior fins, not shown.

The radome 202 is generally fabricated from a material suitable for outdoor use and has a suitable radio frequency (RF) transmission properties, while providing sufficient structural rigidity to inhibit excessive deflection due to wind loading. Suitable materials include, but are not limited to, glass reinforced plastics, thermoplastic compounds, fiberglass, and UV stabilized plastics, such as outdoor grade polyvinyl chloride (PVC).

The antenna array 208 is disposed within the interior volume 206 adjacent to the radome 202. The antenna array 208 generally includes a plurality of radiating elements 210 disposed below the antenna side 234 of the radome 202. In one example, radiating elements 210 are arranged in an 8×8 array. The radiating elements 210 may alternatively different in number and/or arrangement. The radiating elements 210 are generally a metal patch configured to communicate signals on a wireless or mobile network, such as 4G and 5G networks. In one example, the radiating elements 210 are arranged to form a phased array of beam-forming antenna elements 210.

The antenna circuit board 212 generally includes a printed circuit board (PCB) 240 to which at least one chip package 214 is mounted. The chip package 214 includes at least one integrated circuit (IC) die electrically and mechanically mounted to a package substrate (not shown). An optionally interposer (not shown) maybe disposed between the IC die and the package substrate. The chip package 214 is electrically and mechanically mounted to to the PCB 240 utilizing solder balls (not shown) or other suitable connection.

Although only one chip package 214 is illustrated in FIG. 1, two to as many chip packages 214 as may fit on the PCB 240 may utilized as needed. Additionally, each chip package 214 may have one IC die to as many IC dies as may fit within each chip package 214 as needed.

The antenna circuit board 212 generally includes passive circuit components (not shown), control circuitry, a power supply, and an array of transceivers. The control circuitry and the array of transceivers may be embodied on the circuitry of the one or more chip packages 214 mounted to the PCB 240.

The control circuitry residing in the chip package 214 is coupled to the power supply and to the transceivers residing in the antenna assembly 106. The control circuitry is also coupled to one or more data ports formed on the PCB 240. The data ports enable the antenna assembly 106 to communicate with an external electronic device, such as a base band unit of a cell site. The control circuitry residing in the chip package 214 includes processors or other digital logic for processing signals that may be produced and/or received by the antenna array 208.

The power supply is similarly coupled to the control circuitry and to the transceivers. The power supply is also coupled to one or more power ports formed on the PCB 240. The power ports allow the antenna assembly 106 to received power from an external power source, such as a generator or the electrical grid.

The transceivers are coupled to the power supply, the control circuitry and the antenna array 208. The transceivers include circuitry having at least one or more of digital-to-analog converters (DAC), analog-to-digital converters (ADC), filters, modulators and high-performance RF front ends. The RF front ends are coupled to the individual radiating elements of the antenna array.

The exposed surface of the chip package 214 faces the heat sink 204. Thermal interface material (TIM) is disposed between the chip package 214 and the heat sink 204 such that a conductive heat transfer path is established through the TIM between the chip package 214 and the heat sink 204. The TIM may be a thermal gel, thermal epoxy, thermal grease, thermally conductive epoxy, phase-change materials (PCMs), conductive tapes, and silicone-coated fabrics among other suitable materials.

As disclosed above, at least one active cooling device 216 is utilized in the antenna assembly 106 to remove heat generated by the circuitry and devices disposed within the housing 238. In one example, an active cooling device 216 is present in or in contact with the head sink 204. The active cooling device 216 includes a conduit 226 for flowing a heat transfer fluid therethrough, with the ends of the conduit 226 providing the inlet and outlet ports of the active cooling device 216. The conduit 226 of the active cooling device 216 is fluidly coupled to ports 220 formed in the housing 238. The ports 220 are adapted to sealing connect to the conduits 112, 114 so that the heat transfer fluid may be pumped through the head sink 204, the heat exchanger 108 and antenna assembly 106 to cool the chip package 214 and other components disposed within the antenna assembly 106.

In another example, an active cooling device 216 is present between the chip package 214 and the head sink 204. This cooling device 216 may be utilized in addition or alternatively to the cooling device 216 disposed in the heat sink 204. The active cooling device 216 includes a conduit 218 for flowing a heat transfer fluid therethrough. The conduit 218 of the active cooling device 216 is fluidly coupled to ports 220 formed in the housing 238. The ports 220 are adapted to sealing connect to the conduits 112', 114' so that the heat transfer fluid may be pumped through the heat exchanger 108 and antenna assembly 106 to cool the chip package 214 disposed within the antenna assembly 106.

It is contemplated that an active cooling device 216 may be present in another location in or in contact with the housing 238.

Figure 3A:
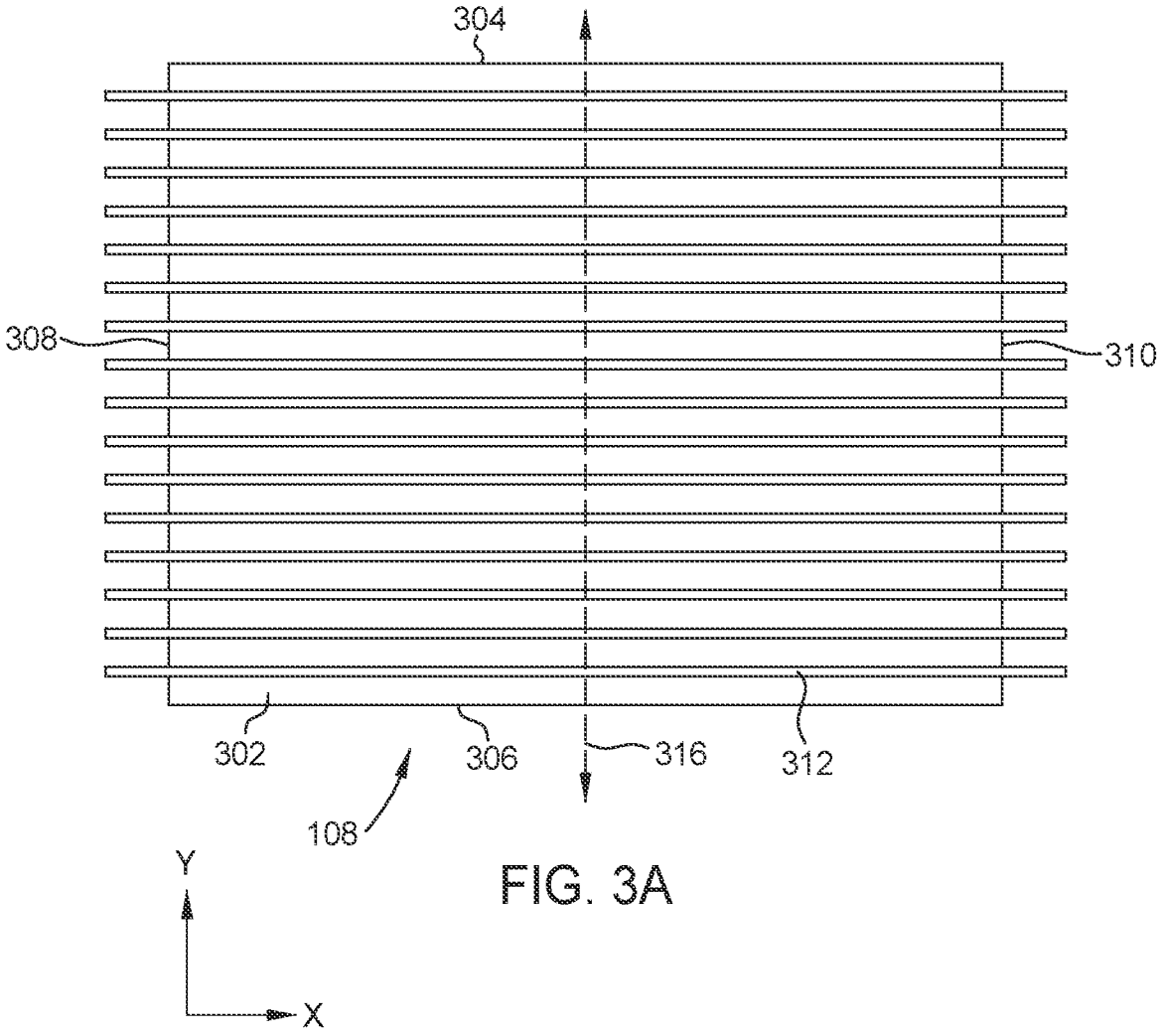
FIGS. 3A-3B are schematic side views of a heat exchanger illustrating different configurations of outer heat transfer fins.

FIG. 3A is a schematic side view of one example of the heat exchanger 108. The heat exchanger 108 generally includes a tubular body 302 having top surface 304, a bottom surface 306, a front side 308 and a mounting side 310. The mounting side 310 is used to couple the heat exchanger 108 to the structure 102 (shown in FIG. 1), through the use of brackets, clamps and/or fasteners, not shown. The body 302 of the heat exchanger 108 is fabricated from a material having good heat transfer properties, such as aluminum or other metal. The body 302 of the heat exchanger 108 may be fabricated as and/or from a single mass of material, or alternatively be fabricated from modular sections sealingly coupled together. The body 302 of the heat exchanger 108 may also be a cylindrical tube, a polygonal tube, ring shaped, or have other suitable geometry. In the example depicted in FIG. 3A, the body 302 is a cylindrical ring having a center line 316. In one example, center line 316 is aligned with the Y-axis. When the body 302 is configured as a cylindrical ring, the front side 308 and the mounting side 310 are part of a singular outside diameter wall of the body 302.

Figure 3B:
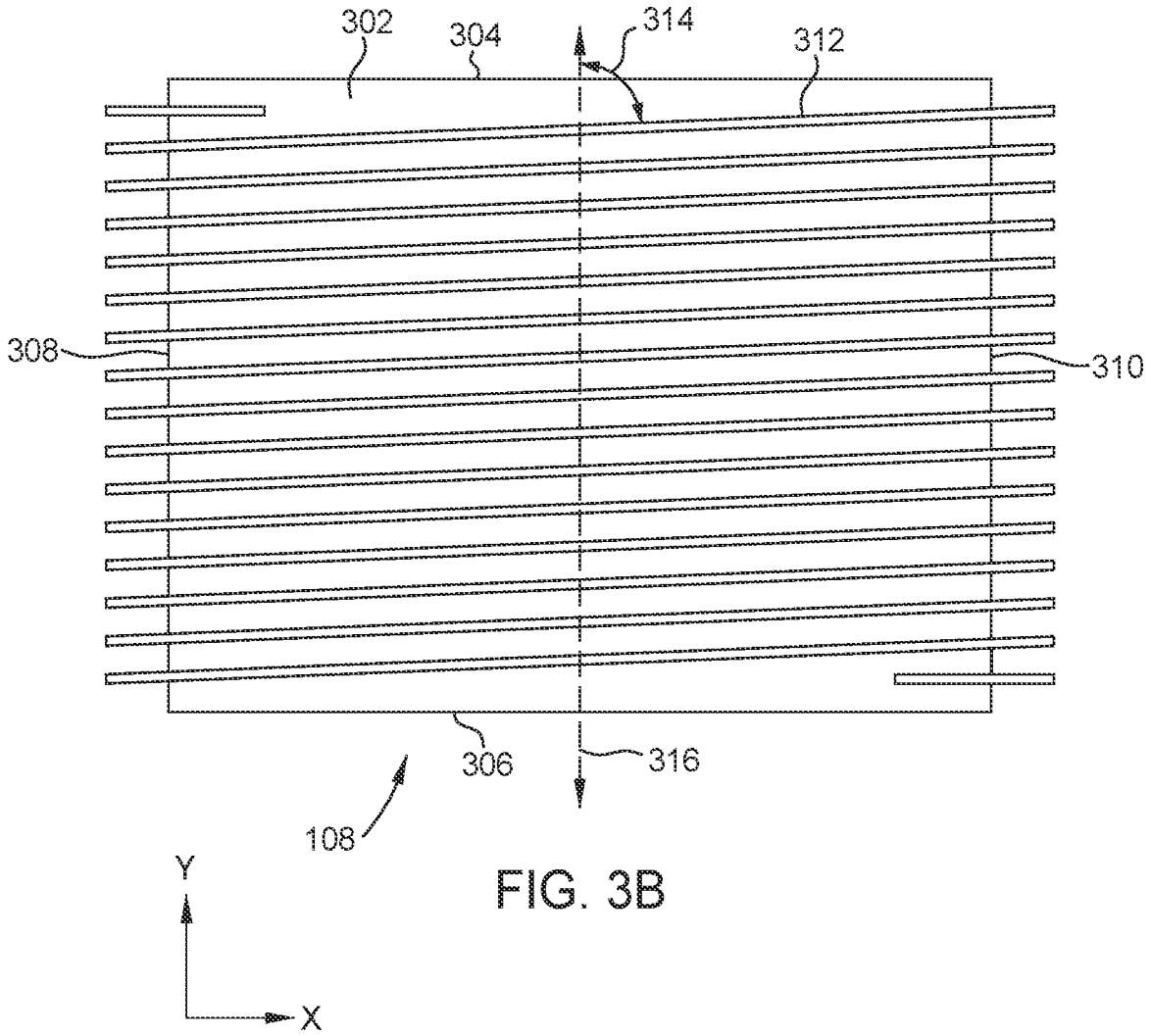

The heat exchanger 108 also includes one or more outer heat transfer fins 312. In the example of FIG. 3A, a plurality of outer heat transfer fins 312 are illustrated arranged in parallel rows. Each outer heat transfer fin 312 generally has an orientation that is parallel to the X/Z plane (e.g., horizontal plane) and perpendicular to the center line 316. Alternatively, the outer heat transfer fins 312 may have an orientation that is disposed at an acute angle 314 relative to center line 316, such as illustrated in FIG. 3B. Each of the outer heat transfer fins 312 may be configured as a contiguously ring, as a plurality of ring segments, or other suitable geometry. Each of the outer heat transfer fins 312 may also be solid, perforated, corrugated or have other suitable geometry.

The generally horizontal or near horizontal orientation of the outer heat transfer fins 312 effectively promotes good air circulation horizontally around the body 302 when surface air (e.g., wind) is present in the environment in which the antenna system 100 is disposed. The air circulation horizontally around the body 302 along and between the outer heat transfer fins 312 enhances heat transfer away from the body 302, thus beneficially increasing the heat transfer efficiency of the heat exchanger 108.

FIG. 4 is schematic sectional view of one example of the heat exchanger 108 that may be utilized with the antenna assembly 106 of the antenna system 100. As noted above, when cylindrical, the body 302 of the heat exchanger 108 includes an outside diameter wall 402 and an inside diameter wall 404. The inside diameter wall 404 bounds a center passage 406 formed though the body 302. The center passage 406 is open to both the top and bottom surfaces 304, 306 of the body 302, thus allowing air to flow though the heat exchanger 108 along the center line 316. The center passage 406 may optionally include inner fins, later described with reference to FIG. 6 below.

Continuing to refer to FIG. 5, the body 302 of the heat exchanger 108 includes a main cooling volume 408 and a return volume 410. The volumes 408, 410 are fluidly separated (i.e., isolated) by an interior wall 418. The volumes 408, 410 may be generally cylindrical rings. In one example, the main cooling volume 408 is larger than the return volume 410. The main cooling volume 408 is disposed outward and circumscribes the return volume 410.

The main cooling volume 408 has an inlet port 430 and an outlet port 432. The inlet port 430 is coupled to the outlet conduit 112 via a fitting 440 to allow heat transfer fluid exiting the active cooling element(s) 116 of the antenna assembly 106 to be received in the main cooling volume 408 of the heat exchanger 108. The outlet port 432 is coupled to the pump inlet conduit 116 via a fitting 440 to allow heat transfer fluid exiting the heat exchanger 108 to be routed to the inlet of the pump 110.

The main cooling volume 408 includes a first plenum 412, a second plenum 414 and a third plenum 416. The first plenum 412 is bounded on one side by the top surface 304 and on the other side by the second plenum 414. The first plenum 412 is also bounded on one side by the outside diameter wall 402 and on the other side by the interior wall 418. The first plenum 412 may be a cylindrical ring, or have another suitable shape. The inlet port 430 is formed through the top surface 304 and is open to the first plenum 412.

The second plenum 414 is bounded on one side by the first plenum 412 and on the other side by the third plenum 416. The second plenum 414 is also bounded on one side by the outside diameter wall 402 and on the other side by the interior wall 418. The second plenum 414 may be a cylindrical ring, or have another suitable shape. The second plenum 414 generally includes a plurality of main heat transfer fins 428. The main heat transfer fins 428 may extend into the second plenum 414 from one or both of the outside diameter wall 402 or the interior wall 418. The main heat transfer fins 428 are generally configured to allow the flow of heat transfer fluid to pass from the first plenum 412 through the second plenum 414 to the third plenum 416.

The third plenum 416 is bounded on one side by the bottom surface 306 and on the other side by the second plenum 414. The third plenum 416 is also bounded on one side by the outside diameter wall 402 and on the other side by the interior wall 418. The third plenum 416 may be a cylindrical ring, or have another suitable shape. The outlet port 432 is formed through the bottom surface 306 and is open to the third plenum 416.

The return volume 410 has an inlet port 434 and an outlet port 436. The inlet port 434 is coupled to the pump outlet conduit 118 via a fitting 440 to allow heat transfer fluid exiting the outlet of the pump 110 to be received in the return volume 410 of the heat exchanger 108. The outlet port 436 is coupled to the inlet conduit 114 via a fitting 440 to allow heat transfer fluid exiting the heat exchanger 108 to be routed to the active cooling element(s) 116 of the antenna assembly 106.

The return volume 410 includes a fourth plenum 422, a fifth plenum 424 and a sixth plenum 426. The fourth plenum 422 is bounded on one side by the bottom surface 306 and on the other side by the fifth plenum 424. The fourth plenum 422 is also bounded on one side by the inside diameter wall 404 and on the other side by the interior wall 418. The fourth plenum 422 may be a cylindrical ring, or have another suitable shape. The inlet port 434 is formed through the bottom surface 306 and is open to the fourth plenum 422.

The fifth plenum 424 is bounded on one side by the fourth plenum 422 and on the other side by the sixth plenum 426. The fifth plenum 424 is also bounded on one side by the inside diameter wall 404 and on the other side by the interior wall 418. The fifth plenum 424 may be a cylindrical ring, or have another suitable shape. The fifth plenum 424 may optionally include a plurality of interior heat transfer fins 420 (shown in phantom). The interior heat transfer fins 420 may extend into the fifth plenum 424 from one or both of the inside diameter wall 404 or the interior wall 418. The interior heat transfer fins 420 are generally configured to allow the flow of heat transfer fluid to pass from the fourth plenum 422 through the fifth plenum 424 to the sixth plenum 426.

The sixth plenum 426 is bounded on one side by the top surface 304 and on the other side by the fifth plenum 424. The sixth plenum 426 is also bounded on one side by the inside diameter wall 404 and on the other side by the interior wall 418. The sixth plenum 426 may be a cylindrical ring, or have another suitable shape. The outlet port 436 is formed through the top surface 304 and is open to the sixth plenum 426.

Figure 5A:
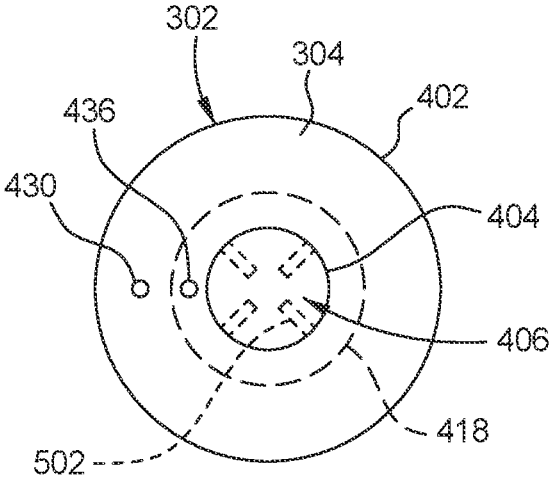
FIG. 5A is a top view of the active heat exchanger of FIG. 4.

FIG. 5A is a top view of the active heat exchanger 108 of FIG. 4. As shown in FIG. 5A, the inlet port 430 and the outlet port 436 are illustrated disposed through the top surface 304 of the body 302 of the heat exchanger 108. The inlet port 430 is positioned outward of the outlet port 436 relative to the center line 316 of the body 302.

Also illustrated in phantom in FIG. 5A are inner heat transfer fins 502 that extend inward from the inside diameter wall 404 into the center passage 406 of the body 302. The inner heat transfer fins 502 have a generally radial and vertical orientation.

Figure 5B:
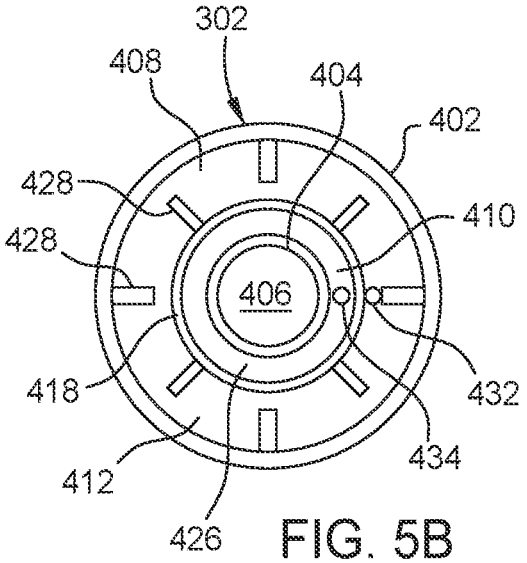
FIGS. 5B-D are sectional views of the active heat exchanger taken through section lines 5B-5B, 5C-5C, and 5D-5D of FIG. 4.
Figure 5C:
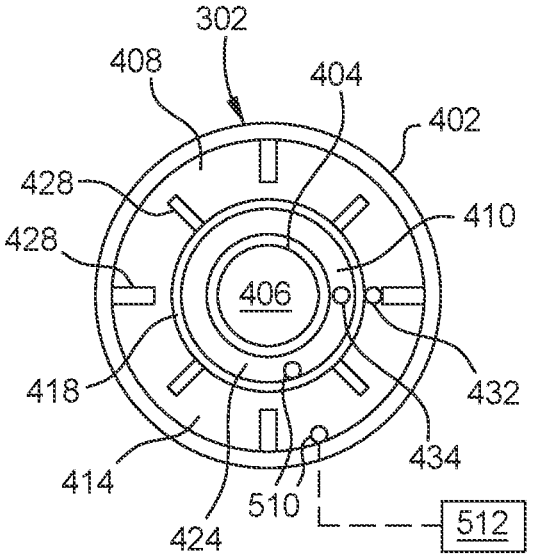
Figure 5D:
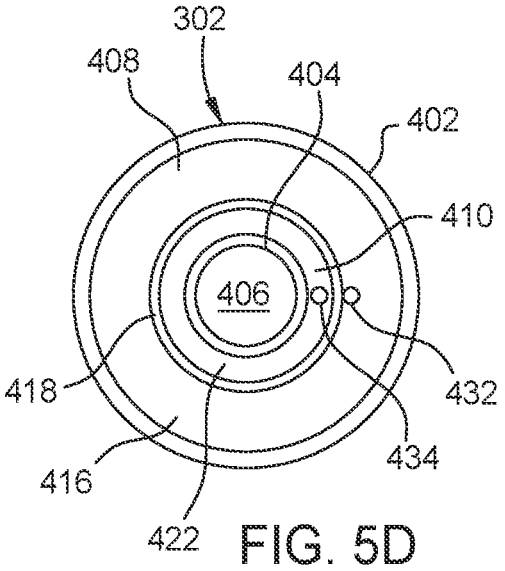

FIGS. 5B-D are sectional views of the active heat exchanger 108 taken through section lines 5B-5B, 5C-5C, and 5D-5D of FIG. 4. In FIG. 5B, the section line 5B-5B passes horizontally through the first and sixth plenums 412, 426 in the X/Z plane. The main cooling fins 414 can been seen from the first plenum 412 extending into the second plenum 414. The main cooling fins 414 have a generally radial and vertical orientation. The main cooling fins 414 may be coupled to either or both of the interior wall 418 and the outside diameter wall 402. In the example depicted in FIG. 5B, the main cooling fins 414 extend from both the interior wall 418 and the outside diameter wall 402 in an interleaving manner. The main cooling fins 414 provide increased surface area to promote heat transfer from the heat transfer fluid to the body 302 of the heat exchanger 108, where the heat may be efficiently transferred to the ambient environment surrounding the antenna system 100.

In FIG. 5C, the section line 5C-5C passes horizontally through the second and fifth plenums 414, 424 in the X/Z plane. The main cooling fins 414 can been seen extending into the second plenum 414 from both the outside diameter and interior walls 402, 418. In FIG. 5C, the ports 432, 434 formed through the bottom surface 306 of the body 302 can be seen in the third and fourth plenums 416, 422 disposed below the second and fifth plenums 414, 424.

Additionally illustrated in FIG. 5C are one or more optional heaters 510 that may be interfaced with the heat exchanger 108 to heat the fluid passing through the body 302. The heaters 510 may be disposed in the material comprising the body 302, disposed outside of the body 302, and/or disposed in one or both of the volumes 408, 410 of the body 302. The heaters 510 may be a resistive heater or other suitable heater. For example, the heaters 510 may be a resistive cartridge heater coupled to a heater controller 512 disposed proximate the heat exchanger 108. The heater controller 512 is operable to control the heat generated by the heaters 510 so that the fluid being circulated through the body 302 and delivered to the antenna assembly 106 is maintained above a predetermined threshold temperature.

In FIG. 5D, the section line 5D-5D passes horizontally through the third and fourth plenums 416, 422 in the X/Z plane. The ports 432, 434 formed through the bottom surface 306 of the body 302 are illustrated separated by the interior wall 418.

Figure 6:
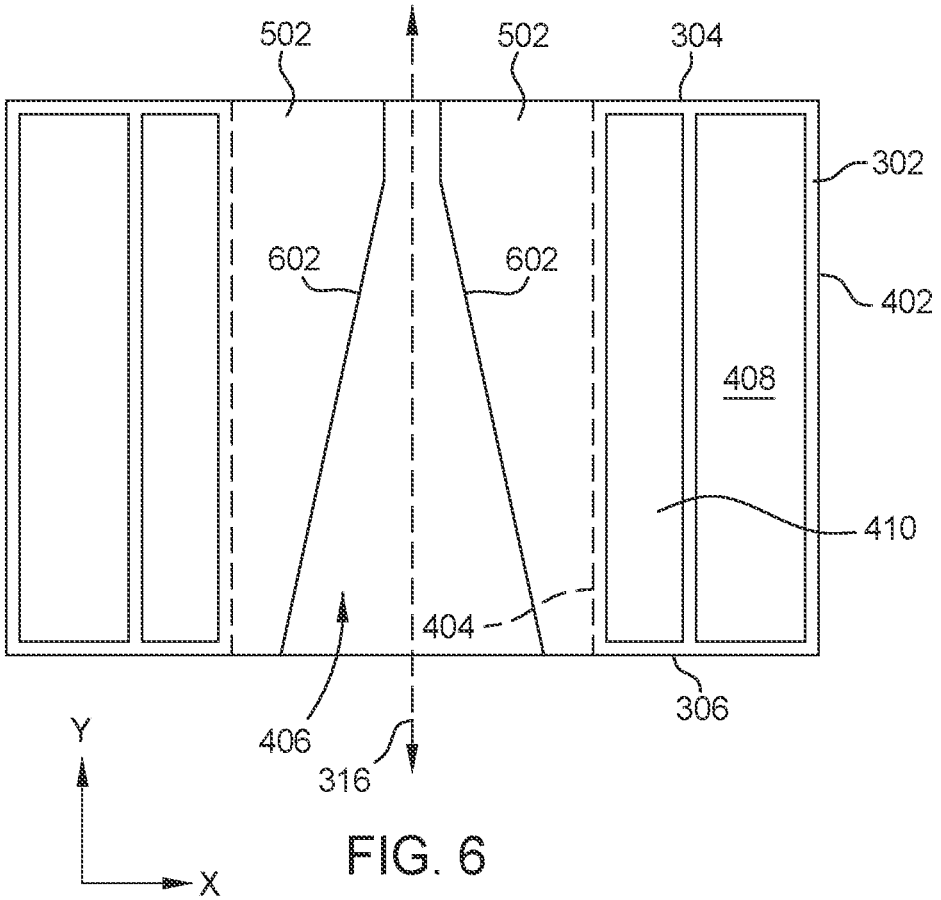
FIG. 6 is a simplified schematic sectional view of one example of an active heat exchanger illustrating inner heat transfer fins.

FIG. 6 is a simplified schematic sectional view of one example of an active heat exchanger 108 illustrating one example of the inner heat transfer fins 502. The inner heat transfer fins 502 may alternatively have a different arrangement. The inner heat transfer fins 502 generally extend from the inside diameter wall 404 in a radial direction towards the center line 316 of the body 302 of the heat exchanger 108. Each of the inner heat transfer fins 502 generally have orientations that are planer and parallel to the center line 316. Each of the outer heat transfer fins 312 may be configured as a contiguously ring, as a plurality of ring segments, or other suitable geometry. Each of the inner heat transfer fins 502 may also be solid, perforated, corrugated or have other suitable geometry.

The surface area of the inner heat transfer fins 502 may be substantially uniform across different regions of the fins 502. For example, the surface area of the inner heat transfer fins 502 in a region proximate to the bottom surface 306 of the body 302 may have the same surface area as a region of the inner heat transfer fins 502 proximate to the top surface 304 of the body 302. Alternatively, the surface area of the inner heat transfer fins 502 may be different across different regions of the fins 502. For example and as shown in FIG. 6, the surface area of the inner heat transfer fins 502 in the region proximate to the bottom surface 306 of the body 302 may have less surface area as compared to the region of the inner heat transfer fins 502 proximate to the top surface 304 of the body 302. Providing more fin surface area proximate to the top surface 304 of the body 302 increases the rate of heat transferred to air present in the passage 406. In the example depicted in FIG. 6, the inner heat transfer fins 502 includes an inner edge 602. At least a portion of the inner edge 602 is disposed at an angle tapering inward (i.e., towards the center line 316) as the inner edge 602 nears the top surface 304 of the body 302. Stated differently, the inner heat transfer fins 502 may have a first side coupled to the exterior side of the inside diameter wall 404, and a second side (that forms the edge 602) disposed closer to the axial center line 316 of the ring- or tube-shaped body, the second side of the inner heat transfer fins 502 spaced further from the axial center line 316 proximate to the bottom surface 306 of the body 302 than that of a second side of the inner heat transfer fins 502 disposed proximate to the top surface 304 of the body 302. The air preferentially heated at the upper region of the passage 406 promotes vertical air movement through the passage 406, which increases the heat transfer efficiency of the heat exchanger 108, thus allowing a smaller and more compact size without loss of heat transfer performance.

Figure 7:
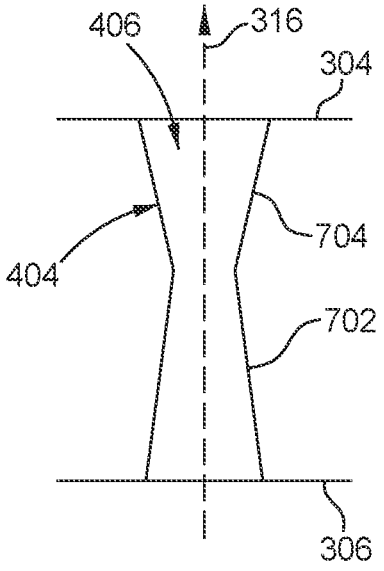
FIG. 7 is simplified schematic partial sectional view of another example of an active heat exchanger illustrating a flow inducing center flow passage.

FIG. 7 is a simplified schematic partial sectional view of another example of an active heat exchanger 108 configure to induce flow vertically through the center flow passage 406. In the example depicted in FIG. 7, the inside diameter wall 404 is not cylindrical as illustrated in FIG. 4, but rather has a nozzle or hour glass-like profile. For example, a lower portion 702 of inside inner diameter wall 404 proximate to the bottom surface 306 tapers inward and upward towards the center line 316 of the body 302, while an upper portion 704 of the inside diameter wall 404 proximate to the top surface 304 flares outward and upward away from the center line 316 of the body 302. The hour glass-like profile of the inside diameter wall 404 is configured to induce vertical area flow through the passage 406 that promotes heat transfer from the body 302 to the ambient environment. The inside diameter wall 404 may also include inner heat transfer fins 502, as discussed above with reference to FIGS. 5A and 6.

Thus, the antenna system described above provides improved thermal management of high performance electronics within the antenna assembly. Advantageously, the efficient thermal management enables greater processing speeds with lower ultra-high speeds with ultra-low latency, while enabling a beneficial reduction in the size, weight and cost of the antenna assembly.

While the foregoing is directed to embodiments of the present invention, other and further embodiments of the invention may be devised without departing from the basic scope thereof, and the scope thereof is determined by the claims that follow.

What is claimed is:

1. A heat exchanger comprising:

a tube shaped body having an inside wall, an outside wall, a top surface and a bottom surface;

a main cooling volume defined within the body, the main cooling volume comprising:

a first plenum formed in the body adjacent the top surface, the first plenum having an inlet formed through the top surface; and a second plenum formed in the body and fluidly coupling a third plenum to the first plenum, the third plenum formed in the body adjacent the bottom surface and the second plenum, the third plenum having an outlet formed through the bottom surface; and a plurality of main heat transfer fins extending into the second plenum, at least some of the plurality of main heat transfer fins coupled to the outside wall;

a passage formed through the body and bounded by the inside wall; and one or more outer heat transfer fins coupled to an exterior side of the outside wall.

2. The heat exchanger of claim 1 further comprising:

a return volume disposed within the body inward of the main cooling volume, the return volume having an inlet disposed through the bottom surface of the body and an outlet disposed through the top surface of the body.

3. The heat exchanger of claim 2, wherein the one or more outer heat transfer fins comprises:

a plurality of ring-shaped fins having an orientation perpendicular to an axial center line of the tube-shaped body.

4. The heat exchanger of claim 2, wherein the one or more outer heat transfer fins have an orientation disposed at an acute angle relative to an axial center line of the tube-shaped body.

5. The heat exchanger of claim 2, wherein the main cooling volume and the return volume have cylindrical ring shapes, and are separated by a cylindrical interior wall.

6. The heat exchanger of claim 5, wherein at least some of the plurality of main heat transfer fins extending into the second plenum are coupled to the inside wall.

7. The heat exchanger of claim 2 further comprising:

a plurality of interior heat transfer fins extending into the passage from the inside wall.

8. The heat exchanger of claim 7, wherein a surface area of the plurality of interior heat transfer fins is greater in a region proximate to the top surface of the body relative to a region proximate to the bottom surface of the body.

9. The heat exchanger of claim 1 further comprising:

one or more heaters disposed in a material of the body, disposed in one or both of the volumes, and/or disposed on an exterior of the body.

10. The heat exchanger of claim 1, wherein the inside wall has an hour glass-like shape.

11. The heat exchanger of claim 1 further comprising:

a plurality of inner heat transfer fins coupled to an exterior side of the inside wall, the inner heat transfer fins having a radial orientation.

12. The heat exchanger of claim 11, wherein the plurality of inner heat transfer fins have a first side coupled to the exterior side of the inside wall and a second side disposed closer to an axial center line of the tube-shaped body, the second side of the inner heat transfer fins spaced further from an axial center line proximate to the bottom surface of the body than that of a second side of the inner heat transfer fins disposed proximate to the top surface of the body.

13. A heat exchanger comprising:

a cylindrical ring-shaped body having an inside diameter wall, an outside diameter wall, a top surface and a bottom surface, the inside diameter wall bounding a passage formed vertically through the body;

a main cooling volume formed in the body between the top surface and the bottom surface, the main cooling volume disposed proximate to the outside diameter wall, the main cooling volume having an inlet formed through the top surface and an outlet formed through the bottom surface;

a return volume formed in the body adjacent the inside diameter wall and circumscribed by the main cooling volume, the return volume having an outlet formed through the top surface and an inlet formed through the bottom surface;

one or more outer heat transfer fins coupled to an exterior side of the outside diameter wall;

a plurality of main cooling fins extending into the main cooling volume in an interleaving radial orientation; and a plurality of inner heat transfer fins extending into the passage in a radial orientation from the inside diameter wall.

14. The heat exchanger of claim 13, wherein the plurality of inner heat transfer fins have a first side coupled to the exterior side of the inside diameter wall and a second side disposed closer to an axial center line of the ring-shaped body, the second side of the inner heat transfer fins spaced further from an axial center line proximate to the bottom surface of the body than that of a second side of the inner heat transfer fins disposed proximate to the top surface of the body.

15. An antenna system comprising:

an antenna assembly comprising:

an antenna array;

a radome disposed over the antenna array; and an active cooling device disposed below the radome and having a passage formed therein for circulating a heat transfer fluid therethrough;

a heat exchanger comprising:

a cylindrical ring-shaped body having an inside diameter wall, an outside diameter wall, a top surface and a bottom surface, the inside diameter wall bounding a passage formed vertically through the body;

a main cooling volume formed in the body between the top surface and the bottom surface, the main cooling volume disposed proximate to the outside diameter wall;

an inlet formed through the top surface and coupling the main cooling volume to an outlet the active cooling device of the antenna assembly;

an outlet formed through the bottom surface and coupled to the main cooling volume;

one or more outer heat transfer fins coupled to an exterior side of the outside diameter wall;

a plurality of main cooling fins extending into the main cooling volume; and a pump coupled between the outlet of the main cooling volume and an inlet of the active cooling device.

16. The antenna system of claim 15, wherein the heat exchanger further comprises:

a plurality of inner heat transfer fins extending into the passage in a radial orientation from the inside diameter wall.

17. The heat exchanger of claim 16, wherein the plurality of inner heat transfer fins have a first side coupled to the exterior side of the inside diameter wall and a second side disposed closer to an axial center line of the cylindrical ring-shaped body, the second side of the inner heat transfer fins spaced further from an axial center line proximate to the bottom surface of the body than that second side of the inner heat transfer fins proximate to the top surface of the body.

18. The antenna system of claim 15 further comprising:

a return volume formed in the body adjacent the inside diameter wall and circumscribed by the main cooling volume, the return volume having an outlet formed through the top surface and coupled to the inlet of the active cooling device, the return volume having an inlet formed through the bottom surface and coupled to the pump.

19. The antenna system of claim 15, wherein the one or more outer heat transfer fins coupled to the exterior side of the outside diameter wall further comprises:

a plurality of ring-shaped outer heat transfer fins having an orientation perpendicular to an axial center line of the cylindrical ring-shaped body; and a plurality of inner heat transfer fins extending into the passage in a radial orientation from the inside diameter wall, the inner fins having more surface area proximate to the top surface of the body than proximate to the bottom of the body.

20. The antenna system of claim 15 further comprising:

one or more heaters disposed in a material of the body, disposed in one or both of the volumes, and/or disposed on an exterior of the body.

* * * * *